US008133259B2

(12) United States Patent
Roehrig et al.

(10) Patent No.: US 8,133,259 B2
(45) Date of Patent: Mar. 13, 2012

(54) PACIFIER

(75) Inventors: Peter Roehrig, Vienna (AT); Ernst W. Beranek, Vienna (AT)

(73) Assignee: Mam Baby Artikel Gesellschaft m.b.H., Vienna (AT)

( * ) Notice: Subject to any disclaimer, the term of this patent is extended or adjusted under 35 U.S.C. 154(b) by 411 days.

(21) Appl. No.: 12/462,194

(22) Filed: Jul. 29, 2009

(65) Prior Publication Data

US 2010/0030264 A1 Feb. 4, 2010

(30) Foreign Application Priority Data

Jul. 30, 2008 (EM) ..... 000979299-0002

(51) Int. Cl.
*A61J 17/00* (2006.01)

(52) U.S. Cl. ..... 606/234; D24/194

(58) Field of Classification Search ..... 606/234–236; D24/193–196; 215/11.1–11.6
See application file for complete search history.

(56) References Cited

U.S. PATENT DOCUMENTS

| | | | | | |
|---|---|---|---|---|---|
| 5,403,349 | A * | 4/1995 | Rohrig | ..... | 606/234 |
| 5,653,731 | A * | 8/1997 | Rohrig | ..... | 606/234 |
| 5,954,749 | A * | 9/1999 | Fields et al. | ..... | 606/234 |
| 6,447,536 | B1 * | 9/2002 | Hinshaw | ..... | 606/235 |
| 7,753,886 | B2 * | 7/2010 | Vath et al. | ..... | 606/234 |
| D626,653 | S * | 11/2010 | Roehrig et al. | ..... | D24/194 |

FOREIGN PATENT DOCUMENTS

| | | |
|---|---|---|
| EM | 000979299-0001 | 8/2008 |
| EM | 000979299-0002 | 8/2008 |

* cited by examiner

*Primary Examiner* — Kevin T Truong
(74) *Attorney, Agent, or Firm* — Abelman, Frayne & Schwab

(57) ABSTRACT

A child's pacifier having a shield with a concave side and a convex side, a nipple extending outwardly from the concave side and a handle extending outwardly from the convex side. The shield is in the shape of two wings, each wing having two lobes, with the shield having a plurality of holes and a curved edge providing a bumper.

4 Claims, 5 Drawing Sheets

PACIFIER

BACKGROUND OF THE INVENTION

1. Field of the Invention

The present invention relates to pacifiers for children. More particularly, this invention relates to a pacifier having a plurality of perforations and recesses and a curved edge allowing for greater comfort and ease of cleaning.

2. Description of the Related Art

It is well known that infants and toddlers may be comforted if they are given a pacifier. Generally, all pacifiers have a nipple that is placed into the child's mouth, and a shield that remains outside the child's mouth, preventing the child from swallowing or choking on the pacifier. A handle is typically provided to give the child or a supervising person a method of holding the pacifier.

Pacifiers are typically made of multiple components with different materials. Preferably, the pacifier nipple is made of a soft and flexible material such as silicone, latex, rubber, thermoplastic elastomer (TPE) or other synthetic compound. The shield and handle are typically made of a more rigid material, such as nylon, polycarbonate or other suitable thermoplastic. The nipple is attached inside the pacifier shield by fastening in a conventional manner, for instance, by clamping, gluing, etc.

Pacifiers may be made integrally formed, typically of a plastic that is selected to provide the nipple with sufficient flexibility and the shield and handle with adequate rigidity. However, the rigidity required for the shield typically results in the nipple of integrally formed pacifiers being more rigid than desired. Another design, as taught in U.S. Pat. No. 6,695,869, is a pacifier formed by overmolding a more rigid inner substrate (the shield) with a more flexible outer substrate (the nipple).

SUMMARY OF THE INVENTION

It is an object of this present invention to provide a pacifier of multiple components in which the nipple is retained securely and shield perforations reduce the mass of the plastic and aid the fit of the shield on the child's face, as well as increase ventilation of the skin surrounding the child's mouth. A curved edge of the shield provides a bumper to soften the edge and make the pacifier more comfortable for the child.

Another object of the invention is that shield perforations and recesses provide for greater rotation and agitation of the pacifier when it is sterilized in boiling water, allowing for more efficient and reduced sterilization time. This is especially advantageous as it reduces the time the delicate nipple is exposed to the boiling water.

Another object of the invention is to provide a pacifier which is made of a resilient non-toxic material, durable in construction, inexpensive to fabricate and simple to manufacture.

These and other objects and advantages of the present invention will become more apparent to those of ordinary skill in the art upon consideration of the attached drawings and the following description of the preferred embodiments which are meant by way of illustration and example only, but are not to be construed as in any way limiting the invention disclosed and claimed herein.

BRIEF DESCRIPTION OF THE DRAWINGS

Further advantages and features of the present invention will become apparent from the detailed description of a preferred embodiment of the invention with reference to the accompanying drawings, in which.

DETAILED DESCRIPTION OF THE INVENTION

Figure 1:
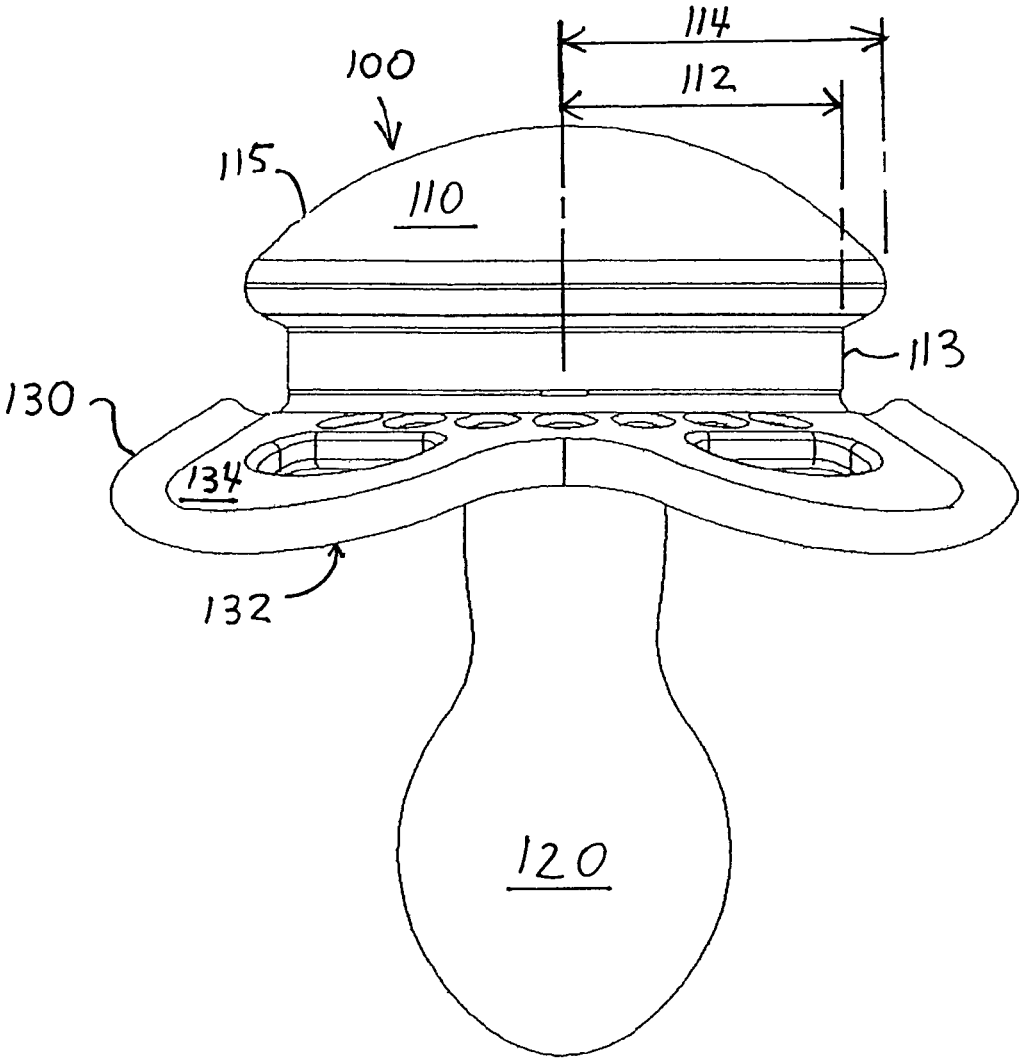
FIG. 1 is a front view of the pacifier.

FIG. 1 shows an implementation of a pacifier 100, with mushroom-shaped handle 110, nipple 120 and shield 130. The handle 110 has a radius 112 for the "stem" portion 113 of the mushroom shape, and a radius 114 for the "cap" portion 115 of the mushroom shape. The shield 130 has a concave surface 132 and a convex surface 134, with the handle 110 being mounted to the convex surface and the nipple 120 being mounted to the concave surface.

Figure 2:
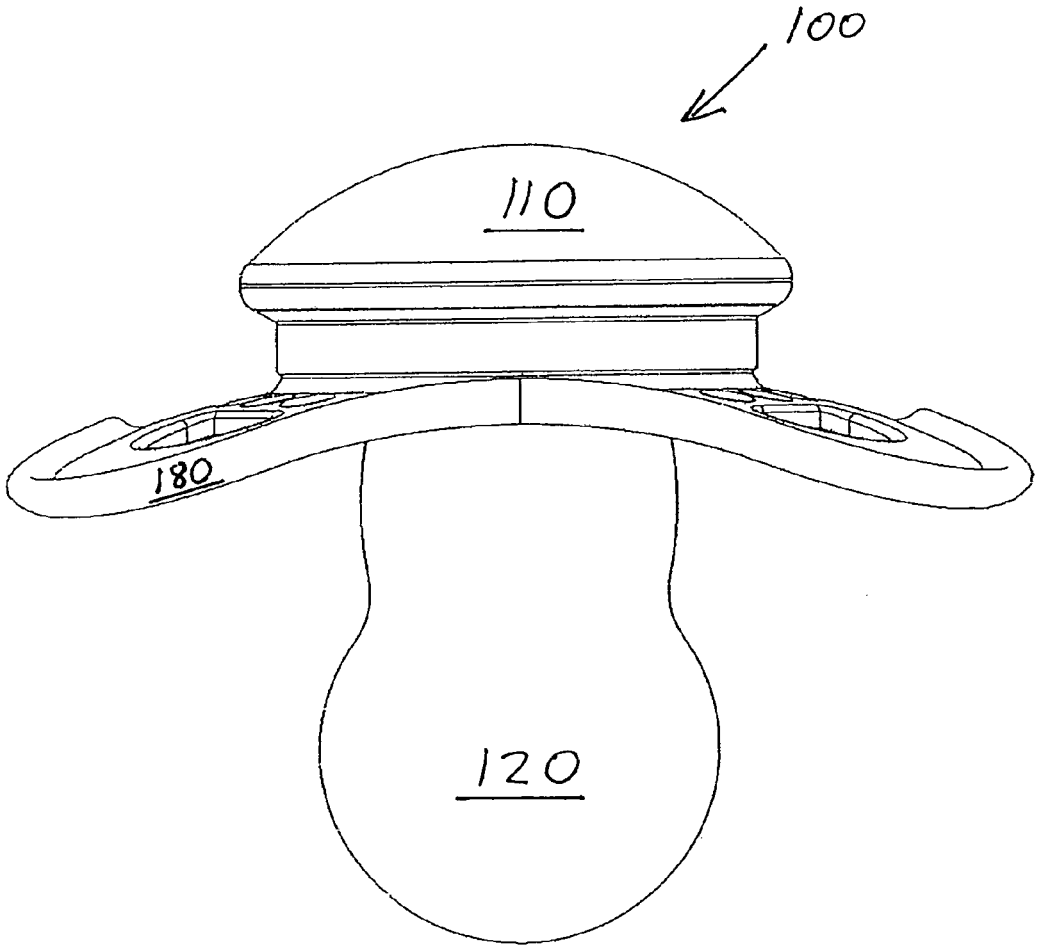
FIG. 2 is a right view of the pacifier.

As seen in FIG. 2, the edge 180 of the shield 130 is thicker than the balance of the shield, providing a bumper for greater comfort of the child.

Figure 3:
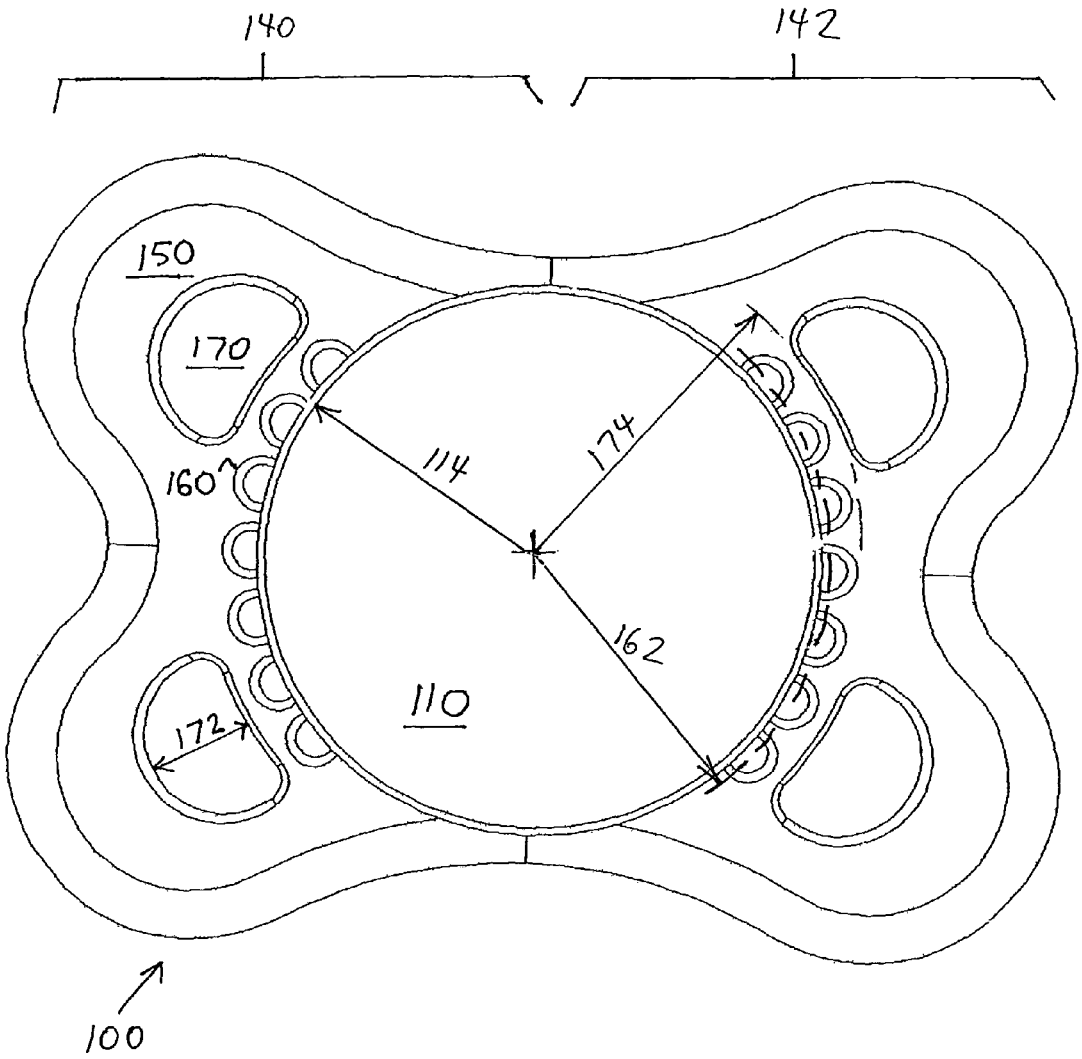
FIG. 3 is a top view of the pacifier.

As seen in FIG. 3, the shield 130 includes two wings, 140 and 142. Each wing has two lobes 150.

Each wing is perforated by a number of circular perforations 160, preferably at least five, though such a value is not limiting, the centers of the perforations aligned along a radius 162 that is greater than the radius 114 of the "cap" of the mushroom-shaped handle.

Each of the four lobes has a D-shaped perforation 170, with maximum radius 172. The straight edges of the D-shaped perforations align tangentially to an arc with radius 174, which is greater than the radius 162 of the arc of the circular perforations 160.

Figure 4:
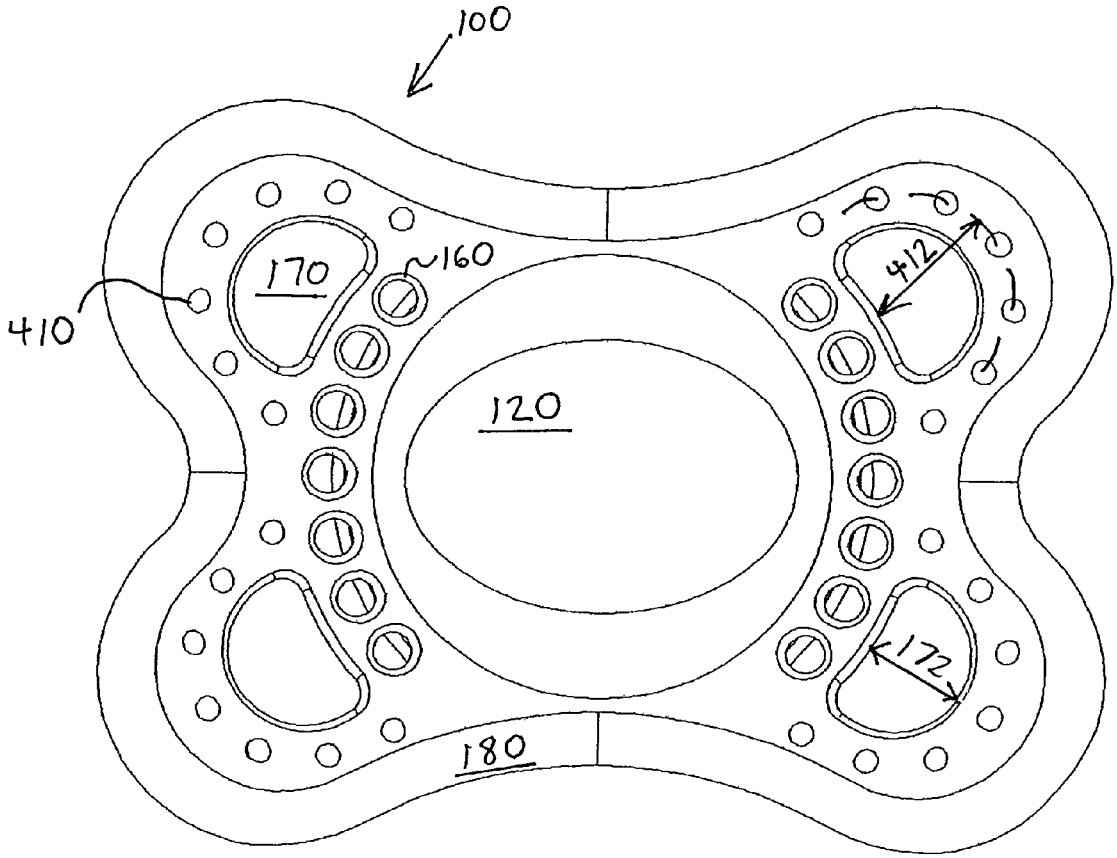
FIG. 4 is a bottom view of the pacifier.
Figure 5:
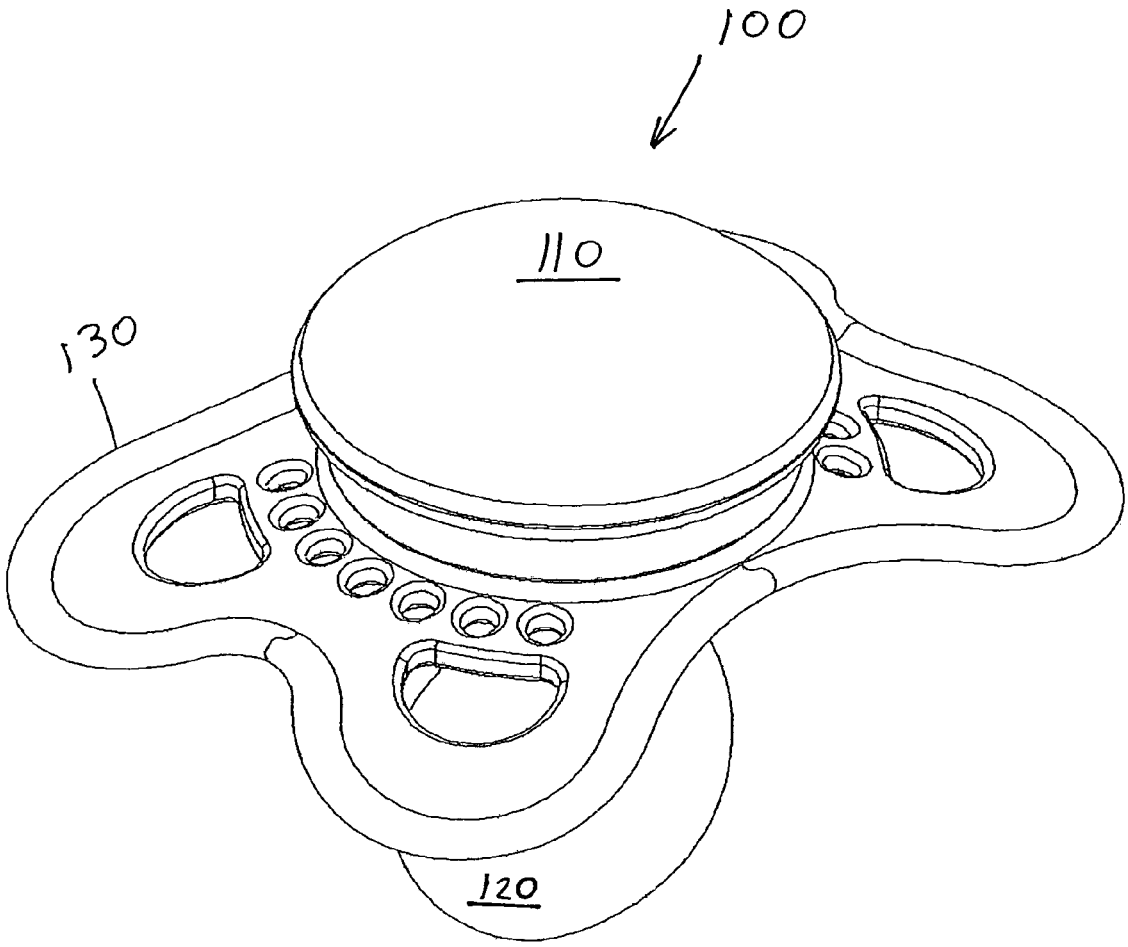
FIG. 5 is a perspective view of the pacifier of the present invention.

FIG. 4 shows another embodiment of pacifier 100 in which the concave surface of the shield has a plurality of recesses 410, for example of circular shape, that are arranged around each of the four D-shaped perforations 170. The recesses 410 align tangentially to an arc with radius 412, which is greater than the maximum radius 172 of the D-shaped perforation 170.

In the foregoing specification, the present invention has been described with reference to specific embodiments thereof. It will, however, be evident that various modifications and changes can be made thereto without departing from the broader spirit and scope of the invention. The specification and drawings are, accordingly, to be regarded in an illustrative rather than a restrictive sense.

What is claimed is:

1. A child's pacifier comprising:

a nipple;

a mushroom-shaped handle;

a curved shield with two wings, each wing having two lobes, wherein the shield has a concave surface and a convex surface, and wherein the nipple is mounted to the concave surface and the handle is mounted to the convex surface, and wherein each wing is perforated by at least five circular perforations, the centers of the perforations aligned along an arc of curvature greater than the curvature of the handle, and wherein each lobe has a D-shaped perforation, the straight edge of the D-shape aligned tangentially to an arc of curvature greater than the curvature of the arc of the at least five circular perforations, and wherein the shield includes an outer band around the perimeter of the shield, the band having a greater thickness than the balance of the shield.

2. The pacifier of claim 1, wherein the concave surface of the shield has a plurality of recesses offset from the curved portion of the D-shaped perforations.

3. The pacifier of claim 1, wherein the handle and shield are molded as a single piece.

4. The pacifier of claim 3, wherein the concave surface of the shield has a plurality of recesses offset from the curved portion of the D-shaped perforations.

* * * * *